United States Patent [19]

Theurer et al.

[11] 4,295,764

[45] Oct. 20, 1981

[54] MOBILE MACHINE FOR REMOVING SURFACE IRREGULARITIES FROM RAIL HEADS

[75] Inventors: Josef Theurer; Klaus Riessberger, both of Vienna, Austria

[73] Assignee: Franz Plasser Bahnbaumaschinen-Industriegesellschaft m.b.H., Vienna, Austria

[21] Appl. No.: 968,264

[22] Filed: Dec. 11, 1978

[30] Foreign Application Priority Data

Dec. 30, 1977 [AT] Austria ..... 9451/77

[51] Int. Cl.[3] ..... B23D 1/10; B24B 23/00; B23D 7/06

[52] U.S. Cl. ..... 409/296; 409/308; 409/319; 51/178

[58] Field of Search ..... 51/178, 241 LG; 409/296, 178, 308, 337, 319, 340

[56] References Cited

U.S. PATENT DOCUMENTS

| | | | |
|---|---|---|---|
| 1,025,754 | 5/1912 | Little | 51/178 |
| 1,031,640 | 7/1912 | Gherky | 51/178 |
| 1,035,129 | 8/1912 | Nichols | 51/178 |
| 2,093,969 | 9/1937 | Larsson . | |
| 2,124,273 | 7/1938 | Larsson . | |
| 2,741,883 | 4/1956 | Scheuchzer . | |
| 2,779,141 | 1/1957 | Speno, Jr. et al. | 51/178 |
| 3,358,406 | 12/1967 | Speno, Jr. et al. | 51/178 |
| 3,494,297 | 2/1970 | Plasser . | |
| 3,738,066 | 6/1973 | Panetti | 51/178 |
| 3,888,052 | 6/1975 | Panetti | 51/178 |
| 4,050,196 | 9/1977 | Theurer | 51/178 |
| 4,074,468 | 2/1978 | Panetti | 51/178 |

FOREIGN PATENT DOCUMENTS

| | | | |
|---|---|---|---|
| 234137 | 6/1964 | Austria . | |
| 150969 | 5/1904 | Fed. Rep. of Germany | 51/178 |
| 391147 | 2/1924 | Fed. Rep. of Germany | 51/178 |
| 391146 | 3/1924 | Fed. Rep. of Germany | 51/178 |
| 814601 | 9/1951 | Fed. Rep. of Germany . | |
| 905984 | 3/1954 | Fed. Rep. of Germany | 51/178 |
| 1021746 | 6/1958 | Fed. Rep. of Germany | 51/178 |
| 1206461 | 12/1965 | Fed. Rep. of Germany . | |
| 1277069 | 9/1968 | Fed. Rep. of Germany | 51/178 |
| 2701216 | 1/1977 | Fed. Rep. of Germany . | |
| 1060027 | 11/1953 | France . | |
| 583337 | 12/1976 | Switzerland . | |
| 227576 | 1/1925 | United Kingdom . | |
| 1195438 | 6/1970 | United Kingdom . | |

*Primary Examiner*—Roscoe V. Parker
*Attorney, Agent, or Firm*—Kurt Kelman

[57] ABSTRACT

A mobile machine mounted on a track for advancement therealong for removing irregularities from the surfaces of the rail heads comprises a machine frame, a tool carrier vertically adjustably mounted on the machine frame and arranged thereon for guidance along a respective track rail, and a cutter head on the tool carrier. The cutter head has a cutting tool capable of machining the surface of the head of the respective track rail continuously upon advance of the tool carrier along the track rail.

18 Claims, 6 Drawing Figures

MOBILE MACHINE FOR REMOVING SURFACE IRREGULARITIES FROM RAIL HEADS

The present invention relates to a machine mounted on a track for advancement therealong, the track having two rails including heads, for removing irregularities from the surfaces of the rail heads. Known machines of this type comprise a machine frame and a tool carrier vertically adjustably mounted on the machine frame and arranged thereon for guidance along a respective one of the track rails.

U.S. Pat. No. 2,779,141, dated Jan. 29, 1957, discloses a mobile rail grinding machine wherein two wheeled trucks are mounted between the two undercarriages supporting the machine frame on the track. Each truck carries three separate, vertically adjustable grinder heads each of which comprises a grinding disc fixed to a driven shaft. The vertical pressure with which each grinding disc is applied to the rail is regulated by a complex, multi-part control arrangement. Since the grinding disc are only in substantially linear contact with the surface of the rail head, the grinding depth obtained on advancement of the machine along the track is exceedingly small and this makes the machine very inefficient for its cost. A number of passes are required to obtain a desired grinding result, which is not only highly uneconomical but is also disadvantageous because it causes excessively long interruptions of traffic along the track section on which the grinder works.

In the rail grinding machine disclosed in U.S. Pat. No. 3,738,066, dated June 12, 1973, a plurality of carriages with rotary grinding devices are coupled together to form a rail grinding train to reduce the number of work passes. The major disadvantages of such a rail grinding train include their enormous cost, the high personnel requirement, which goes as far as to include the need for personnel-carrying cars, and the high maintenance and planning costs for utilizing such trains. Furthermore, operational problems are encountered when passing magnetic rail contacts, switches and other obstacles in the way of the rotary grinding discs, not to speak of the danger created by sparks coming from these discs during the grinding operations.

German Pat. No. 1,021,746, published Dec. 27, 1957, describes a mobile rail grinding machine with a number of whetstones gliding along the rail heads as the machine advances along the track. This machine, too, requires a number of passes before at least the coarsest surface irregularities are removed by the gliding whetstones. Economically acceptable rail grinding cannot be obtained with this machine.

In our U.S. patent application Ser. No. 879,956, filed Feb. 21, 1978 and now U.S. Pat. No. 4,249,346, we have disclosed a mobile rail grinding machine which comprises a machine frame mounted on the rail of a track for continuously moving in the direction of, and along, the track, two tool carrier frames vertically adjustably mounted on the machine frame successively in the track direction and associated with a respective one of the rails, a group of elongated whetstones mounted on the carrier frames for vertical adjustment to press the whetstones against surface areas of the rails to grind off surface irregularities, and a common drive connected to both carrier frames for imparting to the frames reciprocatory movements in opposite senses in the track direction, which is a working movement additional to that imparted to it simultaneously by the movement of the machine frame. This arrangement has multiplied the grinding efficiency during a single pass of the machine but further increases in the efficiency have proved to be economically desirable.

German Pat. No. 905,984, published July 9, 1953, discloses a machine for planing or machining excess welding material from welded rail joints. This machine is constituted by a tool which is reciprocated along the surface of the rail head by a crank drive to machine the joint. The structure is complex and the operation cumbersome so that the device has found no commercial acceptance.

Rather primitive rail dressing machines are disclosed in German Pat. Nos. 150,969, published May 4, 1904, 391,147, published Feb. 29, 1924, and 391,146, published Mar. 5, 1924, and U.S. Pat. Nos. 1,025,754, dated May 7, 1912, 1,031,640, dated July 2, 1912, and 1,035,129, dated Aug. 6, 1912. According to German Pat. No. 150,969, a track-bound carrier frame is advanced along the track and mounts a pair of elongated grinding bodies wherebetween there is arranged a working wheel with a roughened circumference. German Pat. No. 391,147 discloses a carriage running on an embedded streetcar track and mounting a reciprocatory frame carrying a file for machining the rail surface. German Pat. No. 391,146 relates to a machine for grinding or machining rail head surfaces, wherein a carrier is mounted on a carriage for longitudinal movement along a rail and the carrier mounts a grinding disc and an adjustable cutting tool capable of machining the rail head surface. In the mobile machine for planing rails according to U.S. Pat. No. 1,025,754, a complex mechanism holding a plurality of cutting tools is mounted at the rear of the machine frame. The track grinding machine of U.S. Pat. No. 1,031,640 comprises a light carriage mounting rail grinding blocks. A similar machine is disclosed in U.S. Pat. No. 1,035,129. None of these light machines are economically efficient in satisfactorily grinding rails over extended track sections.

It is the primary object of this invention to provide a machine mounted on a track for advancement therealong and producing not only an increased cutting depth whereby the efficiency of the removal of rail surface irregularities is enhanced but also a higher operating speed while being of relatively simple construction.

The above and other objects are accomplished in accordance with the invention with a mobile machine of the first-indicated type and comprising a cutter head on the tool carrier, the cutter head having a cutting tool capable of machining the surface of the head of the respective track rail continuously upon advance of the tool carrier along the track rail. The tool carrier is rigidly resistant to bending and is arranged for advance in unison with the advancement of the machine. The machine further comprises means for subjecting the tool carrier to a vertically directed loading force, and support and guide rollers mounting the tool carrier on the track rail heads substantially without play with respect to the running surface and the inside surface of the rail heads.

With a machine of this structure, it has been possible to increase the rail dressing efficiency as well as the speed with which the rails are dressed to an unexpected degree. Experiments have shown that even considerable surface irregularities are removed with such a machine in a single pass and at a speed of the order of magnitude of 2 to 6 km/h. Because of resistance of the rigid tool carrier to bending in a vertical direction, not only the crests of relatively short undulations are cut or planed but also longitudinally extending surface irregularities. Compared to rail grinding machines with rotary grinding tools, the machine has not only considerably increased efficiency but also is much less costly in terms of construction, operation and servicing.

The machine of the present invention enables irregularities to be continuously removed from the surface of a rail head according to another aspect of this invention by advancing a succession of cutting tools continuously along the rail head surface at a relatively low speed of the order of 2 to 6 km/h, for example, while adjusting the tools to a desired planing depth of up to 0.3 mm, for instance, and maintaining the tools under a desired vertical pressure to remove the irregularities in the form of a continuous chip. Preferably, the rail head surface is ground smooth subsequent to the removal of irregularities by the cutting tools and in the same operating stage during which the cutting tools are continuously advanced along the rail head surface.

With this method, even coarser surface irregularities are removed from the rail heads rapidly and completely in a most economical manner, assuring not only efficiency but also high quality and simplicity of the operation. Furthermore, the method is highly adaptable to various operating conditions. Combining the cutting with the grinding operation in one stage further improves these qualities of the machine. Since the relatively hard surface layer of the rail head is first cut or planed, the subsequent smooth grinding can be effected much more effectively and economically. The end result is an unusually smooth rail head surface even where the original irregularities were quite pronounced. Track rails dressed by this method provide an exceedingly smooth ride even at very high train speeds, thus not only increasing the comfort of the passengers but also enhancing the operating life of the train cars as well as the track.

In addition, such a combined coarse and fine rail dressing method enables a variety of mobile machines to be utilized, including available machines equipped with grinding tools, including whetstones and rotary grinding discs. The method allows the dead time on the track to be reduced and to increase the length of track being dressed between the ever shorter intervals between trains available as traffic constantly increases.

The above and other objects, advantages and features of the present invention will become more apparent from the following detailed description of certain now preferred embodiments thereof, taken in conjunction with the somewhat schematic drawing wherein FIG. 1 is a side elevational view of a mobile machine according to one embodiment of this invention;

Figures 1, 2, 3, 4, 5, 6:
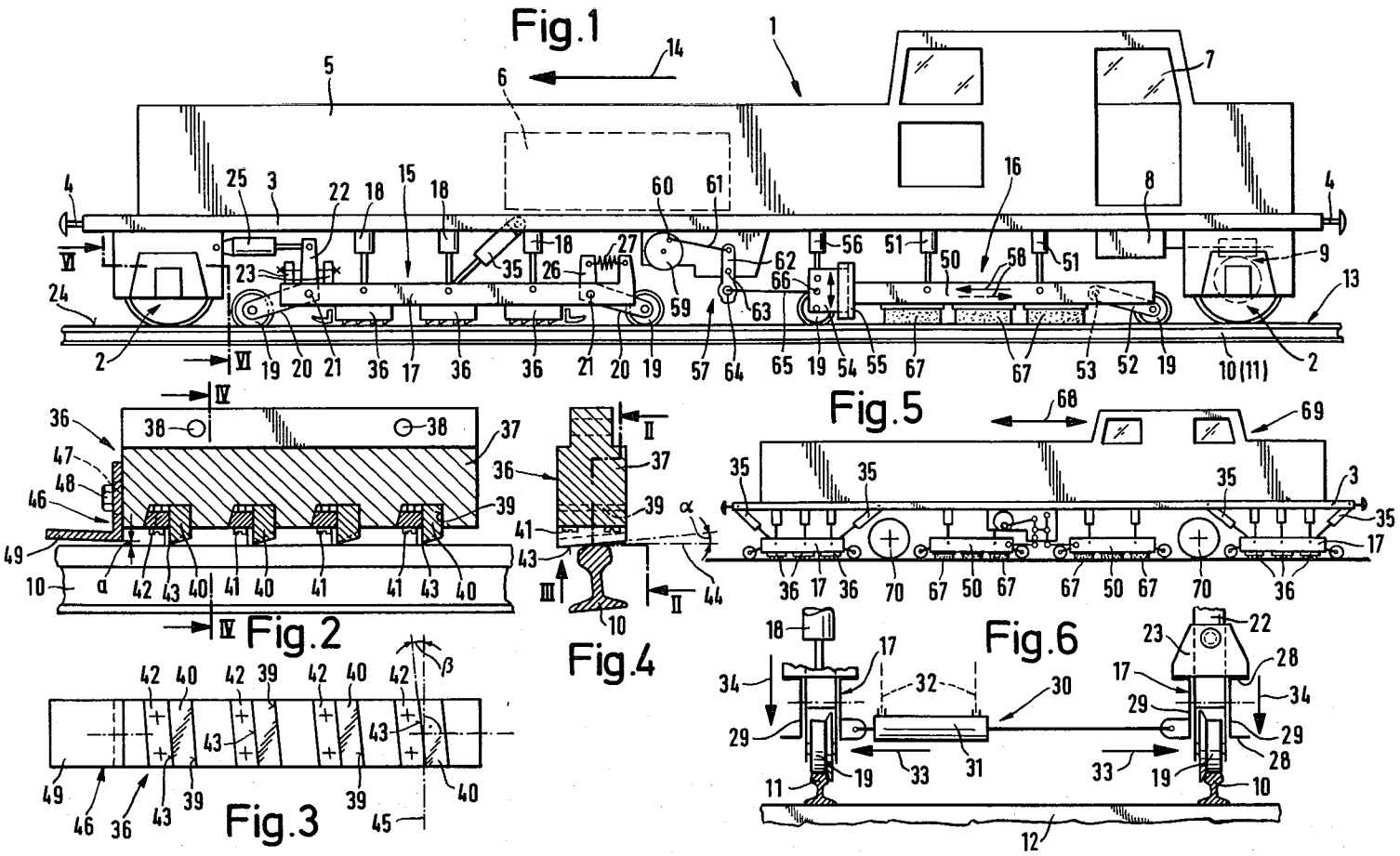
FIG. 2 shows an enlarged view of the cutter head of the machine in a section along line II—II of FIG. 4.
FIG. 3 is a plan view of the cutter head, seen in the direction of arrow III of FIG. 4.
FIG. 4 is a section along line IV—IV of FIG. 2.
FIG. 5 is a simplified side elevational view of a mobile machine according to another embodiment, at a smaller scale.
FIG. 6 is a front view of the macine of FIG. 1 in the area of the tool carrier, seen in the direction of line VI—VI.

Referring now to the drawing and first to FIG. 1, there is shown mobile machine 1 comprising closed chassis 5 carried by machine frame 3 mounted on rails 10, 11 of track 13 supported on ties 13. The machine frame is supported on two undercarriages 2, 2 for advancement of the machine along the track in an operating direction indicated by arrow 14, one of the undercarriages being shown to include drive 9 with a transmission 8 for moving the machine. Chassis 5 carries a power source 6 for the drive of the machine and all the equipment thereon as well as operator's cab 7.

Couplings 4 at respective ends of machine frame 3 enable the mobile machine to be incorporated as a car in a working train.

The illustrated machine comprises a first apparatus 15 for machining off undulations and other irregularities from the surfaces of the heads of the two rails 10 and 11 and an additional apparatus 16 arranged rearwardly thereof, in the direction 14 of advancement of the machine, for grinding the machined surfaces smooth.

The machining apparatus is comprised essentially of a respective tool carrier 17 vertically adjustably mounted on machine frame 3 and arranged thereon for guidance along a respective one of rails 10 and 11, and, in the illustrated embodiment, three cutter heads 36 mounted on the tool carrier sequentially in the direction of the respective rail. In the illustrated embodiment, each cutter head has four cutting tools 40 spaced in this direction from each other, each cutting tool having a cutting edge 43 capable of machining the surface of the head of the respective rail continuously upon advance of the tool carrier along the track rail.

Hydraulic jack units 18 respectively connected to machine frame 3 and tool carrier 17 vertically adjustably mount the tool carrier on the machine frame and may be operated to subject the tool carrier to a vertically directed loading force, each hydraulic jack unit being linked to tool carrier 17 at a point substantially central with respect to a respective one of the cutter heads 36. The tool carrier is rigidly resistant to bending in a vertical direction when a loading force is applied thereto by units 18.

Support and guide rollers 19, which are shown as flanged wheels, at respective ends of tool carrier 17 mount the tool carrier on the respective track rail heads substantially without play with respect to the running surface and the inside surface of the rail heads. In the illustrated embodiment, means for vertically adjusting the tool carrier in relation to the rollers is provided, the illustrated height adjusting means comprising pivotal arms 20 supporting the rollers and being pivotal about horizontal axes 21 extending transversely to the rails. The illustrated pivotal arms are two-armed bell crank levers one of whose arms 22 and 26, respectively, extend upwardly from horizontal axes 21. The height adjusting means further comprises hydraulic jack 25 connected to front pivotal arm 20 for pivoting the arm, the jack having respective ends linked to front undercarriage 2 and upwardly extending arm 22. Stop means consisting of two adjustable stops 23 are mounted on tool carrier 17 for delimiting the pivoting range of front pivotal arm 20 in relation to the tool carrier when jack 25 is operated, the stop means defining a minimal distance of the tool carrier from running surface 24 of the rail head. Hydraulic jack 25 is biased to exert a force on the front pivotal arm to press the roller supported thereby against the rail head and tensioned spring 27 connects upwardly extending rear arm 26 to the tool carrier to press the roller supported thereby against the rail head.

The mounting of the tool carriers on flanged wheels engaging the insides of the rail heads substantially without play assures an accurate guidance of the tool carriers along the respective rails in a vertical and lateral direction. Experience has shown that three cutter heads with four cutting tools will produce the desired machining of the rail head surfaces in a single working pass of the machine and, only in extreme cases, will require two or more passes. By suitably adjusting the cutter heads or cutting tools, each cutting edge will produce a continuous chip of relatively small thickness so that the cutting force exerted by each tool need be only limited while their total, accumulated effect will give quantitatively and qualitatively satisfactory results.

The arrangement of a number of hydraulic jack units 18 corresponding to that of cutter heads 36 and linked to tool carrier 17 at a point substantially central with respect to a respective cutter head assures, in conjunction with the rigid structure of the tool carrier, a vertical loading of the tool carrier over its entire length and certainly over the portions of the carrier on which the cutter heads are mounted. This prevents undue wear on the cutter tools and an optimal machining effect.

Mounting the guide rollers of the tool carriers on the pivotal arms described hereinabove makes for a particularly simple construction in connection with the accurate adjustment of the vertical position of the tool carrier with respect to the surface of the rail head. This adjustment in accordance with the desired operating position is very simply obtained by hydraulic jack 25 in cooperation with stops 23. The above-described and illustrated bell crank lever arrangement, in conjunction with the biased jack operating on the front lever and the tensioned spring operating on the rear lever, makes it possible readily to lift all the tool carriers simultaneously to remove the cutting edges of tools 40 from the rail head surfaces while the machine passes over insulating rail joints, switches and crossings. The stops enable the tool carriers to be lowered accurately to their operating positions after the machine has passed over a respective obstacle.

As shown in FIG. 6, each tool carrier 17 is comprised of two C-profiled carrier beams 29 spaced from each other and arranged symmetrically with respect to a vertical plane of symmetry passing through the rail, each of the beams having outwardly directed flanges 28. Such carriers will have considerable resistance to bending in a vertical direction. Support and guide rollers 19 are mounted on the carriers between the carrier beams, and means 30 presses the rollers against the inside surfaces of the rail heads and maintains them substantially without play with respect to the inside rail head surfaces. This means comprises hydraulic jack means consisting of at least one hydraulic jack 31 extending transversely to rails 10, 11 and linked to the tool carriers arranged along the respective track rails in a pair of carriers. Double-acting jack 31 is selectively supplied with hydraulic fluid through inlet ducts 32 (shown in broken lines). When machine 1 is in operation, hydraulic jack means 30 is operated to exert a horizontal, laterally outwardly directed force in the direction of arrows 33 whereby the support and guide rollers are maintained without play in engagement with the insides of the rail heads while hydraulic jack units 18 simultaneously exert a vertical force in the direction of arrow 34 on the tool carriers to maintain engagement without play of the rollers with the running surfaces of the rails. When passing a switch or crossing, the horizontal force 33 can be eliminated by blocking jack 31 through simultaneously supply of hydraulic fluid to both cylinder chambers of the jack cylinder. Arrangement 30 assures an accurate and secure guidance of the tool carriers along each rail and the cooperation of the horizontal and vertical pressures exerted upon the support and guide rollers produce play-free running of the tool carriers on the rails.

As shown in FIG. 1, a further and obliquely inclined hydraulic jack unit 35 links each tool carrier 17 to machine frame 3. This connection assures that machining apparatus 15, i.e. the tool carriers, advance in unison with the advancement of the machine in the direction of arrow 14 (or in the opposite direction) without in any way interfering with the free movement of the tool carriers vertically or transversely.

Cutter heads 36 are detachably mounted on tool carriers 17. As shown in FIGS. 2 to 4, each cutter head is comprised of holder 37 defining transverse bores 38 for detachably mounting the cutter head between carriers beams 29 of tool carrier by means of bolts or the like passing through bores 38. Cutter head holder 37 defines four transverse grooves 39 spaced from each other in the direction of a respective rail 10, 11 and recessed from the underside of the holder for receiving a respective cutting tool 40 shaped like a planing knife. Each cutting tool is detachably and adjustably mounted on the cutter head for varying the angle of cutting edge 43. The illustrated cutting tool mounting comprises wedge 42 affixed to cutter head holder 37 by means of two screws 41 and detachably holding planing knife 40 in a selected position in recessed groove 39. As seen in FIG. 4, cutting edge 43 of the planing knife encloses acute angle $\alpha$ with plane 44 defined by the running faces of the two rail heads, i.e. the track plane. As usual, the rails are inclined towards the center of the track and angle $\alpha$ corresponds substantially to the angle of inclination of the rails. In this way, the cutting edges of the planing knives extend in a plane extending substantially perpendicularly to the planes of symmetry of the rails. At the same time and as seen in FIG. 3, cutting edges 43 enclose acute angle $\beta$ with another plane 45 extending perpendicularly and transversely to rails 10, 11.

This angular arrangement of the cutting edges assures a substantially symmetrical machining of the rail head surfaces and also produces continuous chips which are easily removed as the machine advances. Since the cutting tools are detachably and adjustably mounted, worn tools may be readily replaced and/or the tools may be readily adjustable by loosening wedges 42.

According to a preferred feature of the present invention, stop means 46 is provided for maintaining a selected vertical distance of the cutting tool from the cutting tool carrier whereby the machining depth of the cutting tool to the rail head surface is delimited. As illustrated herein, this stop means is comprised of an angle iron vertically adjustably mounted on the front face of the first cutter head 36, in operating direction 14, and the rear face of the last cutter head 36, in the operating direction. The vertical adjustment is effected by mounting the respective angle iron on the respective cutter head face by means of clamping bolt 48 extending through an elongated slot in angle iron 46. In this manner distance a of lower flange 49 of angle iron 46 from the rail head surface may be readily adjusted and this distance a delimits the machining depth of cutting tools 40.

This arrangement prevents cutting edges 43 from penetrating deeper than is required for the removal of surface irregularities and thus saves the cutting tools from premature wear.

In the preferred illustrated embodiments, rail grinding apparatus 16 comprises respective tool carriers 50 extending above and along rails 10, 11 and being suspended from machine frame 3 by two hydraulic jack units 51 which enable the tool carriers to be vertically adjusted, the jack units being linked to the machine frame and the tool carriers to enable them to swing back and forth in the directions of arrows 58. Support and guide rollers 19 support the tool carriers at respective ends thereof on the rails in a manner similar to that of tool carriers 17, rear roller or flanged wheel 19 being supported on the free end of pivotal arm 52 which is mounted on tool carrier 50 for pivoting about horizontal, transversely extending axis 53. Front wheel 19 is mounted on bracket 54 which, in turn, is vertically movably mounted in a dove-tailed guide 55. Hydraulic jack 56 connects bracket 54 to machine frame 3 and applies a vertical force thereagainst to press front wheel 19 into engagement with the rail.

In the illustrated rail grinding apparatus 16, tool carrier 50 carries three rail grinding tools 67 which are shown as gliding whetstones detachably mounted on the underside of the tool carrier. Drive means 57 is connected to the tool carrier for imparting thereto a working movement in the direction of the track additional to that simultaneously imparted to it by the advancement of machine 1 in the direction of arrow 14. This working movement is a reciprocatory motion indicated by arrows 58. The illustrated drive means comprises rotary crankshaft 59 mounted on the machine frame and carrying eccentric crankshaft pin 60 linked by connecting rod 61 to the upper end of a two-armed rocking lever 62 pivotal about horizontal and transversely extending axis 63. The lower end of rocking lever 62 carries ball joint 64 connecting one end of rod 65 to the rocking lever while the other rod end is linked to bracket 54 by another ball joint 66 positioned immediately above flanged wheel 19 about at a level with tool carrier 50. Rotation of crankshaft 59 will thus cause the tool carrier to be reciprocated in the directions of arrows 58.

Support and guide rollers 19 for additional tool carrier 50 are held in play-free engagement with the rails by the same type of mechanism 30 as described hereinabove in connection with the guide rollers for tool carriers 17 and illustrated in FIG. 6.

The association of grinding apparatus 16 with planing apparatus 15 has the advantage of providing a machine which will not only effectively remove surface undulations and like irregularities from the running surfaces of the rails but will smooth the machined surfaces to restore their original profile as the whetstones grind these surfaces. Since the whetstones operate on pre-machined surfaces, they are subjected to relatively little wear and may, therefore, be used over relatively long track sections without replacement.

FIG. 5 shows an alternate embodiment of the association of rail planing and grinding apparatus, which enables the machine to operate continuously in opposite operating directions, as indicated by double-headed arrow 68. Machine 69 differs from machine 1 by a shorter distance between undercarriages 70, 70 supporting machine frame 3 for advancement of the machine along the track and by a different arrangement of the rail planing and grinding apparatus. In this embodiment, two additional tool carriers 50 per rail are mounted between the undercarriages, each tool carrier being reciprocated in opposite directions for gliding whetones 67 over the running surfaces of the rails, and a respective one of tool carriers 17 with cutter heads 36 is associated with each rail frontwardly and rearwardly of a respective undercarriage 70 at the ends of machine frame 3. A pair of hydraulic jacks 35 affix each tool carrier 17 to the machine frame to assure that the tool carriers will advance in unison with the machine in either operating direction. This embodiment not only provides a machine which is fully effective in opposite operating directions but also opens up various operating modes enabling the respective operations to be effected in any desired sequence, as will be more fully explained hereinafter.

It will be obvious from the above description of the structure of preferred embodiments that this machine may be used for continuously removing irregularities from the surface of a rail head by advancing a succession of cutting tools along the rail head surface at relatviely low speed, such as about 2 to 6 km/h, while adjusting the tools to a desired planing depth, for instance up to about 0.3 mm, and maintaining the tools under a desired vertical pressure to remove the irregularities in the form of a continuous chip. With this method, even substantial irregularities may be removed from the running surfaces of the rails rapidly and completely and in a very economical manner, the operating results being quantatively and qualitatively of the highest order, and the method being most simple to carry out. At the same time, the method is highly adaptable to various operating conditions. When the successive cutting tools are so adjusted that the planing depth increases successively from cutting tool to cutting tool, a smooth removal of a continuous chip will be assured.

In the preferred method, the rail head surface is ground smooth subsequent to the removal of surface irregularities by the cutting tools and in the same operating stage during which the cutting tools are continuously advanced along the rail head surface. While gliding whetstones have been described and illustrated as grinding tools, it will be obvious to those skilled in the art that grinding discs may also be used, if desired. With this combination of two different modes of removing rail surface irregularities, particularly in a single operating stage, a very high operating efficiency has been achieved. This is based on the fact that the relatively hard surface layer is removed from the rail head first by planing so that the subsequent smooth grinding can be effected much more efficiently and economically. The final result is a very smooth surface of high quality even where the original rail surface is quite irregular. The resultant rails assure a very smooth ride even at high train speeds and reduce the vibrations to which the axles are subjected, thus not only increasing the comfort of the passengers but also increasing the operating life of the undercarriages. The combined planing and grinding not only makes it possible to use the method in various combinations but also shortens the operating time so that the operation can be readily fit into the ever decreasing intervals between passing trains.

The operation of the machines will partly be obvious from the above description of their structure and will hereinafter be described in detail.

Referring first to the embodiment of FIG. 1 machine 1 is brought to the operating site either coupled to a train by couplings 4 or is self-propelled by operating drive 9 while apparatus 15 and 16 is lifted off track 13 by hydraulic jack units 18 and 51, with flanged wheels 19 out of engagement with track rails 10, 11. During this movement of the machine to the operating site, none of the drives 25, 30, 35 and 57 is operated. Upon reaching the operating site, jacks 18 and 51 are actuated to lower tool carriers 17 and 50 onto track 13 and to apply a desired vertical force against the tool carriers while flanged wheels 19 are engaged with the track rails without play by operation of mechanisms 30. When too carrier 17 is lowered, front pivotal arm 20 is pivoted clockwise about axis 21 by jack 25 until upwardly projecting arm 22 engages right or rear stop 23. This positions the tool carrier vertically in relation to running surface 24. At the same time, hydraulic jacks 56 are actuated to press front flanged wheels 19 of additional tool carriers 50 against the respective rails. Drives 9 and 57 are now actuated to advance machine 1 continuously in the direction of arrow 14 at a speed of the order of magnitude of about 2 to 6 km/h while tool carriers 50 are reciprocated in the direction of arrows 58. The continuous advancement of machine 1 in unison with tool carriers 17 will cause undulations and other surface irregularities to be planed by cutting edges 43 and the machined rail surfaces will be ground smooth by the gliding whetstones 67. It has been found that, in a single pass of the machine, apparatus 15 is capable of removing a continuous chip up to a depth of about 0.35 mm and the subsequent grinding effectively smoothed the rail surfaces with a reduced wear on the grinding tools.

Effective results were obtained not only in the removal of short undulations but also of longer irregularities, the cutting depth as well as the downward pressure on the cutting tools being preadjusted and a continuous chip being removed from the rail surfaces with an increasing cutting depth of successive cutting tools.

While the subsequent grinding is effected with machine 1 in a single pass, the embodiment of machine 69 shown in FIG. 5 makes various operating modes possible. For instance, operating in either direction indicated by double-headed arrow 68, apparatus 15 positioned in front of front undercarriage 70 may be used for coarse machining while the machined rail surfaces are smoothed with the whetstones on the two additional tool carriers between the undercarriages. On the other hand, machine 69 may be moved back and forth once over a track section to subject the rails to two successive coarse machining operations by means of the cutting tools on tool carriers 17 positioned forwardly of the front undercarriage in each direction and, in a subsequent back-and-forth movement of the machine over the track section, the machined rail surfaces by be ground smooth by whetstones 67, thus totalling four passes over the track section. In some cases, machining may be effected in a single forward pass while smooth grinding proceeds during the rear movement of the machine over the machined track rails. Further variations will be obvious, depending on the individual rail condition.

While specific embodiments of the mobile machine and method have been described, modofications will readily occur to those skilled in the art without departing from the spirit and scope of the present invention as defined in the appended claims. For instance, depending on the rail surface condition in the track section whose rails are being restored, only some of the cutter heads may be used and/or more than one grinding pass may be necessary to smooth the rail surfaces. Furthermore, the rail heads may be machined in one pass with a mobile machine carrying only cutter heads while smooth grinding may be effected with a separate rail grinding machine in a later stage, for instance after a train has passed over the track section.

What is claimed is:

1. A mobile machine mounted on a track having two rails including heads and the machine being arranged for advancement along the track for removing irregularities from the surfaces of the rail heads to a predetermined depth, which comprises (a) a machine frame, (b) an elongated tool carrier extending in a plane substantially parallel to the track and rigidly resistant to bending out of said plane, and vertically adjustably mounted on the machine frame and arranged thereon for vertical and lateral guidance without play along a respective one of the track rails, (c) a cutter head on the tool carrier, the cutter head having (1) a cutting tool capable of machining the surface of the head of the respective track rail continuously upon advance of the tool carrier along the track rail, and (d) a hydraulic jack unit linking the tool carrier to the machine frame for vertically adjusting the tool carrier and subjecting the tool carrier to a vertically directed loading force sufficient to obtain the predetermined machining depth.

2. The mobile machine of claim 1, wherein the tool carrier is arranged for advance in unison with the advancement of the machine.

3. The mobile machine of claim 1, or 2 further comprising support and guide rollers mounting the tool carrier on the track rail heads substantially without play with respect to the running surface and the inside surface of the rail heads.

4. The mobile machine of claim 1, further comprising stop means for maintaining a selected vertical distance of the cutting tool from the tool carrier whereby the machining depth of the cutting tool in relation to the rail head surface is delimited.

5. The mobile machine of claim 4, wherein the stop means is vertically adjustable on the cutter head for selection of the vertical distance.

6. The mobile machine of claim 4 or 5, wherein the stop means is an angle iron.

7. The mobile machine of claim 1, wherein three of said cutter heads are mounted on the tool carrier sequentially in the direction of the respective rail and each cutter head has four of said cutting tools spaced in said direction from each other.

8. The mobile machine of claim 7, wherein the cutting tools are planing knives.

9. The mobile machine of claim 1 or 7, wherein the rails are inclined towards the center of the track and the cutting tool has a cutting edge enclosing an acute angle with a plane defined by the running faces of the two rail heads, the angle corresponding substantially to the angle of inclination of the rails, and the cutting edge further enclosing an acute angle with another plane extending perpendicularly to the rails.

10. The mobile machine of claim 9, further comprising means for mounting the cutting tool detachably and adjustably on the cutter head for varying the angle of the cutting edge.

11. The mobile machine of claim 1, wherein the hydraulic jack unit is linked to the tool carrier at a point substantially central with respect to the cutter head.

12. The mobile machine of claim 1 or 11, wherein a plurality of said cutter heads are mounted on the tool carrier and a corresponding plurality of said hydraulic jack units link the tool carrier to the machine frame.

13. The mobile machine of claim 3, further comprising means for vertically adjusting the tool carrier in relation to the rollers.

14. A mobile machine mounted on a track having two rails including heads having a running surface and an inside surface, and the machine being arranged for advancement along the track for removing irregularities from the surfaces of the rail heads to a predetermined depth, which comprises (a) a machine frame, (b) an elongated tool carrier extending in a plane substantially parallel to the track and rigidly resistant to bending out of said plane, and vertically adjustably mounted on the machine frame and arranged thereon for vertical and lateral guidance without play along a respective one of the track rails, (c) support and guide rollers mounting the tool carrier on the track rail head substantially without play with respect to the running and inside surfaces of the rail head, (d) a cutter head on the tool carrier, the cutter head having (1) a cutting tool capable of machining the surfaces of the head of the respective track rail continuously upon advancement of the tool carrier along the track rail, (e) a hydraulic jack unit linking the tool carrier to the machine frame for vertically adjusting the tool carrier and subjecting the tool carrier to a vertically directed loading force sufficient to obtain the predetermined machining depth, and (f) means for vertically adjusting the tool carrier in relation to the rollers, the adjusting means comprising (1) pivotal arms supporting the rollers at respective ends of the tool carriers, the arms being pivotal about horizontal axes extending transversely to the rails.

15. The mobile machine of claim 14, wherein the adjusting means further comprises a hydraulic jack connected to a front one of the pivotal arms, in the direction of advancement of the machine, for pivoting the arm and stop means for delimiting the pivoting range of the front pivotal arm in relation to the tool carrier.

16. The mobile machine of claim 15, wherein the pivotal arms are two-armed bell crank levers one of whose arms extend upwardly from the horizontal axes, the hydraulic jack being connected to the upwardly extending arm of the front pivotal arm and biased to exert a force on the pivotal arm to press the roller supported thereby against the rail head, and further comprising a tensioned spring connecting the upwardly extending arm of the rear pivotal arm to the tool carrier to press the roller supported thereby against the rail head.

17. A mobile machine mounted on a track having two rails including heads having a running surface and an inside surface, and the machine being arranged for advancement along the track for removing irregularities from the surfaces of the rail heads to a predetermined depth, which comprises (a) a machine frame, (b) an elongated tool carrier extending in a plane substantially parallel to the track and rigidly resistant to bending out of said plane, and vertically adjustably mounted on the machine frame and arranged thereon for vertical and lateral guidance without play along each track rail, the tool carriers being laterally aligned, (c) support and guide rollers mounting each tool carrier on the track rail head substantially without play with respect to the running and inside surfaces of the rail head, (d) means for pressing the rollers against the inside surfaces of the rail heads and for maintaining them substantially without play with respect to the inside head surfaces, (e) a cutter head on each tool carrier, the cutter head having (1) a cutting tool capable of machining the surfaces of the head of the respective track rail continuously upon advancement of the tool carriers along the track rails, and (f) a hydraulic jack unit linking each tool carrier to the machine frame for vertically adjusting each tool carrier and subjecting each tool carrier to a vertically directed loading force sufficient to obtain the predetermined machining depth.

18. The mobile machine of claim 17, wherein the means for pressing the rollers against the inside rail head surfaces and maintaining them substantially without play comprises hydraulic jack means extending transversely to the rails and linked to the tool carriers arranged along the respective track rails in a pair of carriers.

* * * * *